United States Patent [19]

Brandon et al.

[11] Patent Number: 5,015,109

[45] Date of Patent: May 14, 1991

[54] SHEET FEED CONSTRUCTION FOR COMPACT PRINTERS

[75] Inventors: John M. Brandon; Brian D. Bradley, both of Beavercreek; Richard J. Ratermann, Centerville, all of Ohio

[73] Assignee: Eastman Kodak Company, Rochester, N.Y.

[21] Appl. No.: 441,012

[22] Filed: Nov. 24, 1989

[51] Int. Cl.[5] ..... B41J 13/10

[52] U.S. Cl. ..... 400/624; 400/629; 400/642

[58] Field of Search ..... 400/624, 629, 642, 659, 400/662

[56] References Cited

U.S. PATENT DOCUMENTS

| | | | |
|---|---|---|---|
| 4,583,873 | 4/1986 | Parks et al. | 400/629 |
| 4,723,857 | 2/1988 | Yokoi | 400/693 |
| 4,728,966 | 3/1988 | Piatt et al. | 400/629 |
| 4,763,138 | 8/1988 | Piatt | 400/82 |
| 4,783,669 | 11/1988 | Piatt et al. | 400/624 |

FOREIGN PATENT DOCUMENTS

| | | | |
|---|---|---|---|
| 167988 | 4/1986 | European Pat. Off. | 400/629 |

*Primary Examiner*—Edgar S. Burr
*Assistant Examiner*—Joseph R. Keating
*Attorney, Agent, or Firm*—John D. Husser

[57] ABSTRACT

An improved sheet separator and guide construction for a printer having a supply station and a feeder/platen for feeding a top sheet from a supported sheet stack and transporting it through the printing region. The construction includes a force plate for urging a supported sheet stack so that its top sheet contacts the feeder-platen and is moved toward a supply station egress region. A pair of sheet corner deflectors located respectively at opposite edges of the supply station egress region are constructed to direct sheet corners fed there-against inwardly toward the sheet center, and a central deflector located along a central portion of the egress region in spaced relation between the corner deflectors is constructed to direct the center lead-edge of a sheet fed there-against upwardly toward the printer top.

4 Claims, 4 Drawing Sheets

SHEET FEED CONSTRUCTION FOR COMPACT PRINTERS

FIELD OF THE INVENTION

The present invention relates to compact printers and, more specifically, to improved printer constructions for feeding individual sheets in succession from a supply station through the printing zone.

BACKGROUND ART

U.S. Pat. No. 4,763,138 discloses a compact printer having an integral cut sheet feeder which is quite advantageous as a module for cooperation with personal computers in an office environment, e.g., because of its versatility and compactness. This printer features sheet feed from a supply station by the same platen member that transports the sheet through the printing region, where, for example, an ink jet printing carriage scan prints successive lines.

U.S. Pat. No. 4,783,669 discloses a highly useful sheet supply station for use in printers of the kind described in the '138 patent and also discloses one approach for separating top sheets from the supply stack and guiding them through the printer. The sheet separator of the '669 patent performs well, but has several disadvantages. Thus, the '669 patent approach requires considerable free paper length beyond, and space above, its top sheet buckler posts. Also, it has been found necessary in some applications to adjust the buckler posts for certain paper widths. In addition, it would be desirable to avoid contact between all feed/guide elements and any printed portions of fed sheets.

SUMMARY OF INVENTION

An important aspect of the present invention is to provide improved constructions for printers having integral sheet feeders to avoid the disadvantages noted above. Thus one advantage of the present invention is that its sheet separation construction is compact and can help reduce overall printer size. Another advantage of the present invention is that its operative sheet-separation components perform reliably without adJustments to accommodate different paper width tolerances. A further advantage of the present invention is its paper guide elements serve to smooth any partially bent sheet corners and direct the fed sheets through the printing operation without contacting printed regions on the sheet.

In one preferred embodiment the present invention constitutes an improved sheet separator and guide construction for a printer having a supply station supporting a sheet stack and a feeder/platen for feeding a top sheet from a supported sheet stack and transporting it through the printing region of the printer. The improved construction comprises means for urging a supported sheet stack so that the top sheet contacts the feeder platen and is moved toward a supply station egress region; a pair of sheet corner deflectors located respectively at opposite edges of the supply station egress region, the deflectors being constructed to direct sheet corners fed there against inwardly toward the sheet center; and a central deflector located along a central portion of the egress region in spaced relation between the corner deflectors, the central deflector being constructed to direct the center lead edge of a sheet fed there against upwardly toward the printer top.

BRIEF DESCRIPTION OF DRAWINGS

The subsequent description of preferred embodiments refers to the accompanying drawings wherein.

DETAILED DESCRIPTION OF PREFERRED EMBODIMENTS

Figure 1:
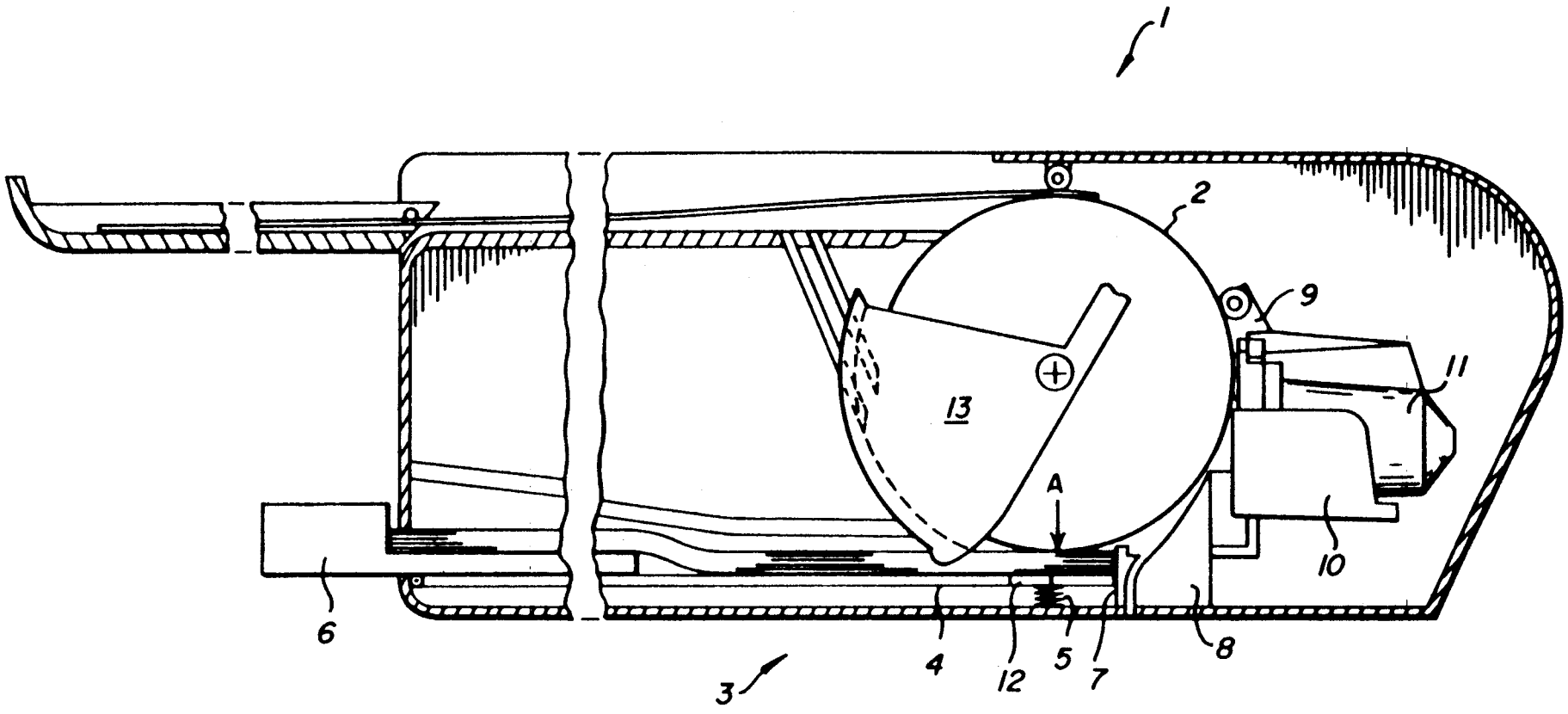
FIG. 1 (PRIOR ART)
FIG. 1 is a cross-sectional view of a prior art printer-feeder of the kind in which the present invention can be advantageously utilized.
Figure 2:
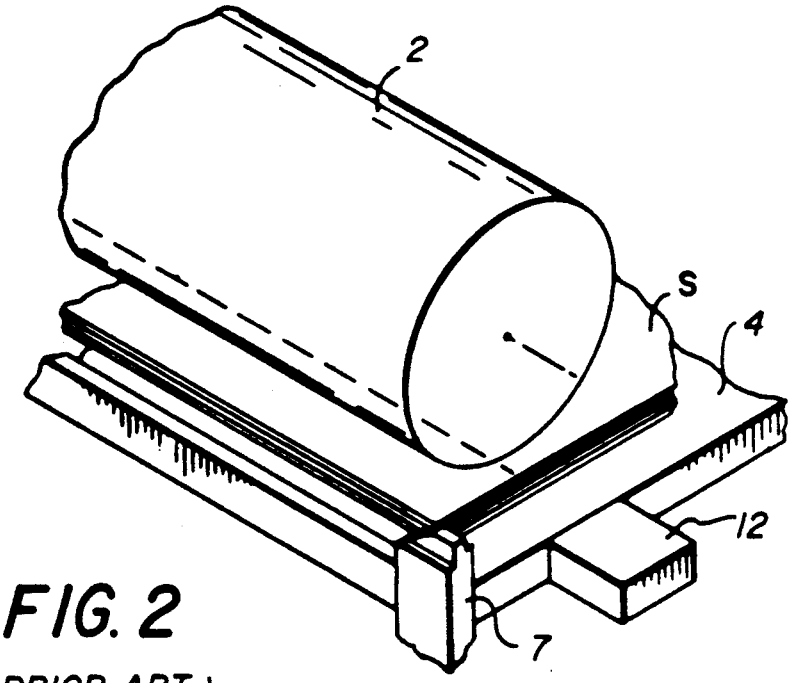
FIG. 2 (PRIOR ART)
FIG. 2 is a schematic perspective view illustrating a portion of the FIG. 1 printer-feeder.

FIGS. 1 and 2 shows the prior art apparatus described in above-noted U.S. Pat. No. 4,783,669, which provides a good example of one kind of feeder-printer in which the present invention is useful. The FIG. 1 feeder-printer 1 comprises a housing 2 rotatably mounting a feeder-platen 2 and having a cut sheet supply station, designated generally 3, in its bottom region, below the feeder-platen. The supply station includes a force plate member 4 hinged at the printer rear and biased upwardly by spring 5 toward the bottom of feeder platen 2. A drawer member 6 is slidingly mounted in the printer bottom to receive and index a stack of sheets S against abutment members 7. Sheet guide means of this printer include fixed bottom guide members 8 and top guide members 9 which are movable with the carriage 10 that supports the print head 11. A tab 12 is provided on force plate 4 to be engaged by a control cam, e.g. a surface of member 13, and disengage the feed engagement between a supported stack and the feeder-platen 2. U.S. Pat. No. 4,763,138 describes other constructions for effecting controlled engagement between feeder-platen 8 and sheet stack S and is incorporated herein by reference for those teachings.

Figure 3:
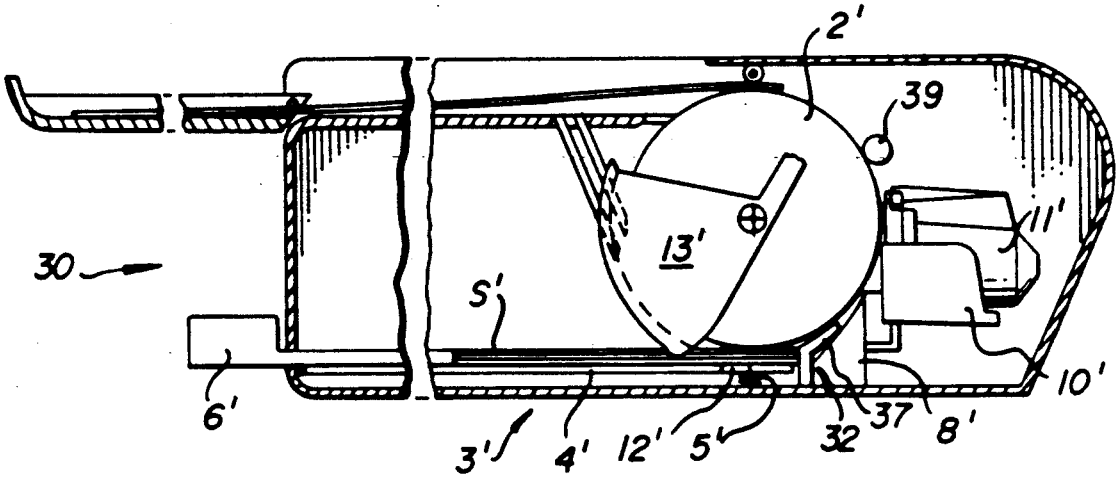
FIG. 3 is a cross-sectional view, similar to FIG. 1, but illustrating a portion of the present invention sheet separation and guide construction.
Figure 4:
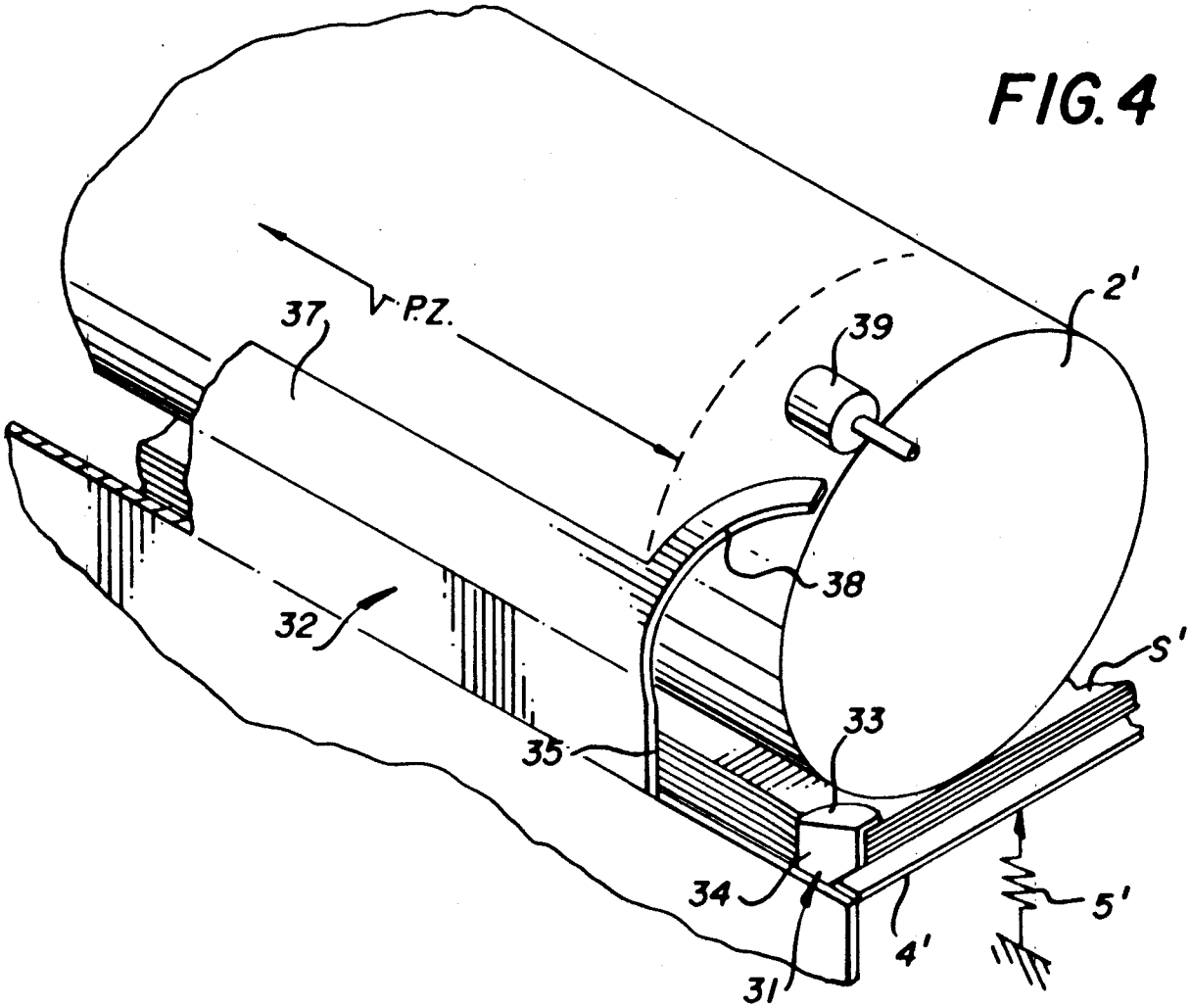
FIG. 4 is a perspective view showing a portion of the FIG. 3 printer.

Referring now to FIGS. 3 and 4, it can be seen that the printer 30 constructed in accord with the present invention is generally the same as the FIG. 1 apparatus, differing primarily in its constructions for separating top sheets from stack S' and for directing the leading ends of fed sheets to and through the printing zone P.Z. Similar structures of FIG. 3 are denoted with the same, but primed, numerals as used in FIG. 1.

Referring particularly to the sheet separating and guiding structure of the FIGS. 3 and 4 embodiment of the present invention, it can be seen that the sheet separating assembly comprises a pair of sheet corner deflectors 31 and a central deflector 32 located in a spaced relation along the line of top sheet egress from the sheet supply station 3'. Deflector 31 each have a top plate 33 overlying the corners of the top sheet of a supported stack and have an upstanding deflector surface 34 at an angle of about 45° to the line of the lead edge of the sheet. The central deflector 32 has edges 35 that are spaced from the deflectors 31 and extends between those edges along a major portion of the sheet stack front. The central deflector provides an upstanding abutment surface 36 to index the sheet stack and an upper portion 37 that slants upwardly away from sheet stack front in spaced relation to the feeder-platen periphery (as best seen in FIG. 3). A pair of sheet smoothing arms 38 extend upwardly and outwardly toward their respective edges of the sheet path from the edges 36 of the central deflector 32. The arms 38 also conform to the periphery of the platen and thus define a feed path that guides fed sheets into the nip of bail rollers 39 and feeder platen 2'.

Figure 5:
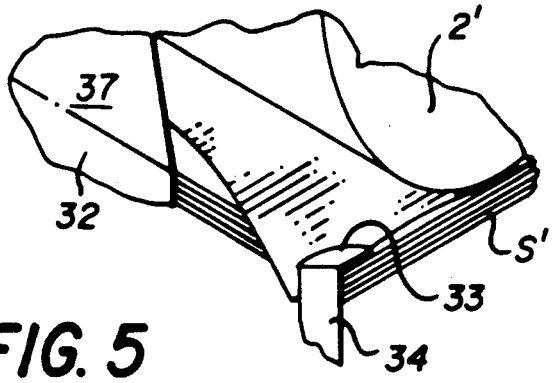
FIG. 5 is a perspective view of a portion of the FIG. 4 construction.
Figure 6:
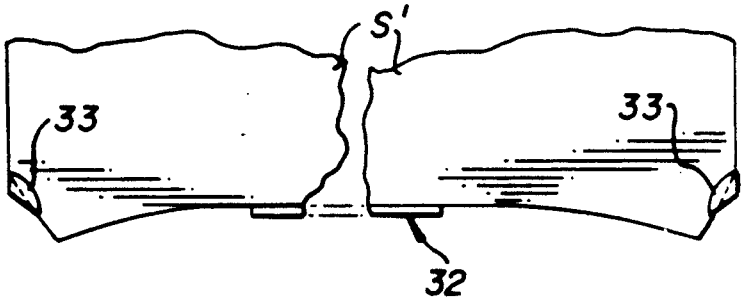
FIG. 6 is a top view of the portion shown in FIG. 5.
Figure 7:
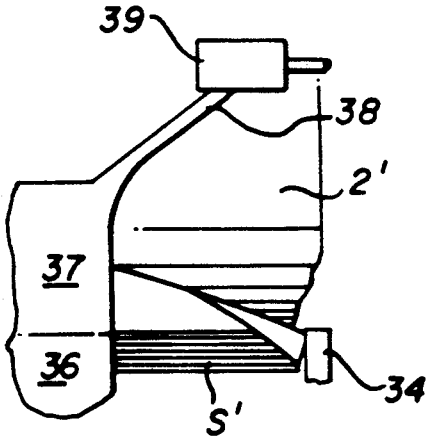
FIGS. 7 and 8 are schematic front views of the apparatus shown in FIG. 4, illustrating the movement of a leading sheet end directed by constructions in accord with the present invention.
Figure 8:
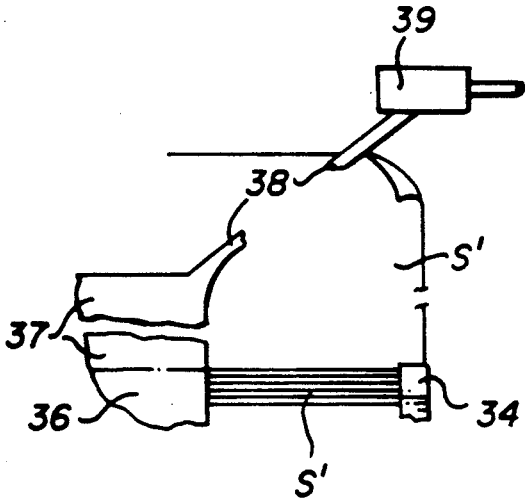

The advantageous functioning of the separator and guide construction Just described will become clear from a description of a sheet feeding sequence with reference also to FIGS. 5–8. Thus, as a set feed sequence commences feeder platen 2' rotates counter clockwise (as viewed in FIG. 3) and its frictional surface moves the top sheet of stack 5' toward the sheet egress region. As shown in FIGS. 5 and 6, the tips of the top sheet corners abut the angled deflector surface 34 and dives-downwardly under the front of top plate 33. At the same time, the center of the lead edge of the top sheet abuts central deflector 32 and is deflected upwardly. These cooperative deflections cause the sheet to bow as shown in FIG. 7 and enable the sheet corners to be released from under top plates 33 without severe creasing. To the extent that some residual bend exists in the sheet corners, the smoothing arms 38 fold back the bend gradually as the sheet corner moves toward the nip between bail rollers 39 and the feeder-platen 2'.

Referring to FIG. 4, it will be noted that the construction of the present invention effects guide of the sheet edges under the edge bail rollers 39 without blocking the print zone P.Z. from its address by print head 11'. Also, it can be seen that the edge bail rollers 39 do not contact printed regions of a fed sheet, nor does the central guide 37.

The invention has been described in detail with particular reference to certain preferred embodiments thereof, but it will be understood that variations and modifications can be effected within the spirit and scope of the invention.

We claim:

1. In a printer having a printing region, a sheet supply station, located below said printing region and constructed to support a sheet, and a rotatable feeder/-platen located above said supply station for feeding a top sheet from a supported sheet stack and transporting it through said printing region, an improved sheet separator and guide construction comprising:

(a) a supply station egress region extending along across the path of sheet feed from said supply station and perpendicular to the direction for sheet feed;

(b) means for urging a supported sheet stack so that the top sheet contacts said feeder-platen and is moved into said egress region;

(c) a pair of sheet corner deflectors located respectively at opposite edges of said egress region, said deflectors being constructed to direct sheet corners feed three-against inwardly toward the sheet's center and downwardly; and (d) a central deflector member located along a central portion of said egress region in spaced relation between said corner deflectors, said central deflector member being constructed to direct the center lead-edge of a sheet fed there-against upwardly toward the printer top at the same time said sheet corners are directed downwardly by said corner deflectors.

2. The invention defined in claim 1 further comprising smoothing arm portions extending from the upper edges of sad central deflector member around the path of feeder/platen rotation and outwardly to the edges of the sheet feed path.

3. The invention defined in claim 2 further comprising a pair of bail rollers mounted to rotatably engage edge zones of said feeder/platen at a location downstream from said supply station egress region and wherein said smoothing arm portions extend to locations proximate said bail rollers.

4. The invention defined in claim 3 wherein said central deflector and its smoothing arms extend around said feeder-platen in closely spaced relation and have a line printing opening between said smoothing arms to allow access by the printing means of said printer.

* * * * *